US007611374B1

(12) United States Patent
Chiu

(10) Patent No.: US 7,611,374 B1
(45) Date of Patent: Nov. 3, 2009

(54) ELECTRICAL WIRE CONNECTION DEVICE

(75) Inventor: Pei-Cheng Chiu, Kaohsiung (TW)

(73) Assignee: Mei Hwa Technology Corp., Kaohsiung (TW)

( * ) Notice: Subject to any disclaimer, the term of this patent is extended or adjusted under 35 U.S.C. 154(b) by 0 days.

(21) Appl. No.: 12/048,229

(22) Filed: Mar. 14, 2008

(51) Int. Cl.
*H01R 11/20* (2006.01)

(52) U.S. Cl. ..... 439/402; 439/418

(58) Field of Classification Search ..... 439/402, 439/403, 408

See application file for complete search history.

(56) References Cited

U.S. PATENT DOCUMENTS 3,899,236 A * 8/1975 Santos ..... 439/402

* cited by examiner

*Primary Examiner*—Ross N Gushi
(74) *Attorney, Agent, or Firm*—Leong C. Lei

(57) ABSTRACT

An electrical wire connection device includes a housing having a top surface and opposite end surfaces that respectively intersect the top surface at end edges of the top surface. Each end edge forms a cutoff. A cover board is openably closed to the top surface of the housing to expose an opening of the cutoff in the respective end surface. The opening allows the insertion of a tip of a hand tool, such as flat-ended screwdriver, to pry the cover board open. In this way, the cover board can be opened easily and efficiently without damage to the housing or the cover board.

4 Claims, 11 Drawing Sheets

ELECTRICAL WIRE CONNECTION DEVICE

BACKGROUND OF THE INVENTION (a) Technical Field of the Invention

The present invention relates to an electrical wire connection device, and in particular to an electrical wire connection device comprising a housing and a cover removably attached to the housing and configured to allow easy and efficient opening of the cover for re-use of the electrical wire connection device.

(b) Description of the Prior Art

FIG. 1 of the attached drawings shows a conventional electrical wire connection device A, which comprises a housing 1 and an interconnection member 2. The housing 1 is made of insulation materials and forms a first wire channel 11 and a second wire channel 12. The first wire channel extends from an end of the housing 1 into the body of the housing 1, but not completely through the body of the housing 1. The second wire channel 12 is substantially parallel to the first wire channel 11 and extends from an end of the housing 1 into and completely through the body of the housing 1 to an opposite end of the housing 1. A lateral side of the second wire channel 12 is open. Extending from a bottom of the housing 1 is cover board 13 that forms a first jointing section 131 that is in the form of and rotatable as a hinge. The cover board 13 is further extended from the first jointing section 131 to a second jointing section 132, which is also in the form and rotatable as a hinge. A remote outer edge of the cover board 13 forms a barb 133. The housing 1 forms in a top surface thereof a recess 14 that extends between the first and second wire channels 11, 12 and the recess 14 is open at the top surface of the housing 1. An outer edge of the top surface of the housing 1 forms an engaging section 15 that releasably and matingly engages the barb 133 of the cover board 13. Further, a protrusion 16 is formed on a bottom of the housing 1 at a location corresponding to the recess 14 and the protrusion 16 extends to a side surface of the housing 1 that is outside the first wire channel 11.

The interconnection member 2 is made of metal materials that are electrical conductive and is made in the form of single or plural blades 21. In the embodiment illustrated, plural blades 21 are taken as an example for explanation. Each blade 21 forms two notches 211.

As shown in FIG. 2, to use the electrical wire connection device A to make connection between two electrical wires, a first one (L1) of the two electrical wires is inserted into the first wire channel 11 of the housing 1 of the electrical wire connection device A, while a second one (L2) of the electrical wires is put into the second wire channel 12 of the housing 1 of the electrical wire connection device A. The interconnection member 2 is positioned in the recess 14 defined in the top surface of the housing 1 and is forcibly driven deeply into the recess 14 so that the blades 21 of the interconnection member 2 pierce through insulation enclosure layers of the electrical wires L1, L2 to have the notches 211 forcibly fit over conductor cores enclosed inside the insulation enclosure layers. Since the interconnection member 2 is made of conductive materials, the electrical wires L1, L2 are electrically connected together. In addition, with the arrangement of the protrusion 16, when the blades 21 of the interconnection member 2 are fit into the recess 14, the blades 21 can be made further deeply into the recess 14 to ensure excellent and secure fitting of the interconnection member 2 in the recess 14, and the protrusion 16 also facilitates mechanical strength of the housing 1. Finally, the cover board 13 is closed onto the top surface of the housing 1 and the barb 133 of the cover board 13 engages the engaging section 15 of the top surface of the housing 1 to securely fix the cover board 13 to the housing 1. In addition, to ensure stable and firm fixing of the cover board 13, the barb 133 of the cover board 13 and the engaging section 15 of the housing 1 are set in tight engagement with each other in order to prevent the cover board 13 from accidental and unexpected opening, leading to exposure of the interconnection member 2 and thus raising risk of leakage of electricity.

An advantage of using the above-described electrical wire connection device A to carry out interconnection between wires is that no stripping of insulation layers of the electrical wires to be connected is necessary. Also, entangling exposed conductor cores of the wires and wrapping the entangled conductor cores with electrical tapes can be eliminated. All these make the above-described electrical wire connection device very popular and appealing in the field.

However, such a conventional electrical wire connection device still surfers certain disadvantages. For example, as shown in FIG. 3, when the interconnection between two wires is done with the electrical wire connection device A, if it is found that the electrical connection is poor during an inspection process, the electrical wire connection device A has to be opened for re-connecting the electrical wires, or when there is a need to modify an electrical circuit that is comprised of the electrical wire connection device A, the electrical wire connection device A may also need to be disassembled for re-assembling or connecting the wires. With such situations, the cover board 13 has to be opened away from the housing 1 in order to proceed with the removal of the wires from the housing 1. However, since the barb 133 of the cover board 13 is set in secured engagement with the engaging section 15 of the housing 1 and also since these parts are often tiny and weak parts, it is difficult to apply a suitable for to open the cover board 13 from the housing 1. Often, pliers or other tools are used to tightly pinch the barb 133 of cover board 13 and forcibly flapping the cover board 13 upwards to open the cover board 13. Nevertheless, the housing 1 and the cover board 13 are usually made of plastics, which are of limited strength. Once such a strong force is applied to the cover board 13 by pliers or hand tools to open the cover board 13, the cover board 13 may subjected to damage resulting from undesired deformation. This deteroriates the tight engagement to be realized between the cover board 13 and the housing 1 and is thus adverse to re-securing of the cover board to the housing.

Thus, it is desired to provide a solution to the above problems.

SUMMARY OF THE INVENTION

The primary purpose of the present invention is to provide an electrical wire connection device, comprising a housing and a cover board, wherein the housing is provided with an engaging section and the cover board is provided with a barb engageable with the engaging section to openably secure the cover board to the housing. The housing has a top surface and opposite end surfaces that respectively intersect the top surface at end edges of the top surface. Each end edge forms a cutoff. When the cover board is closed to the top surface of the housing, the cutoff shows an opening in the respective end surface. The opening allows the insertion of a tip of a hand tool, such as flat-ended screwdriver, to pry the cover board open for disassembling the electrical wire connection device. In this way, the cover board can be opened easily and efficiently without damage to the housing or the cover board.

Another objective of the present invention is to provide an electrical wire connection device, comprising a housing and a cover board, wherein the housing is provided with an engaging section and the cover board is provided with a barb engageable with the engaging section to openably secure the cover board to the housing. The housing forms a rib on an outer surface thereof at a location below the engaging section and a gap is formed therebetween. To open the cover board, a tip of a hand tool, such as flat-ended screwdriver, is inserted into the gap between the rib and the barb that engages the engaging section to pry the cover board open for disassembling the electrical wire connection device. In this way, the cover board can be opened easily and efficiently without damage to the housing or the cover board.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
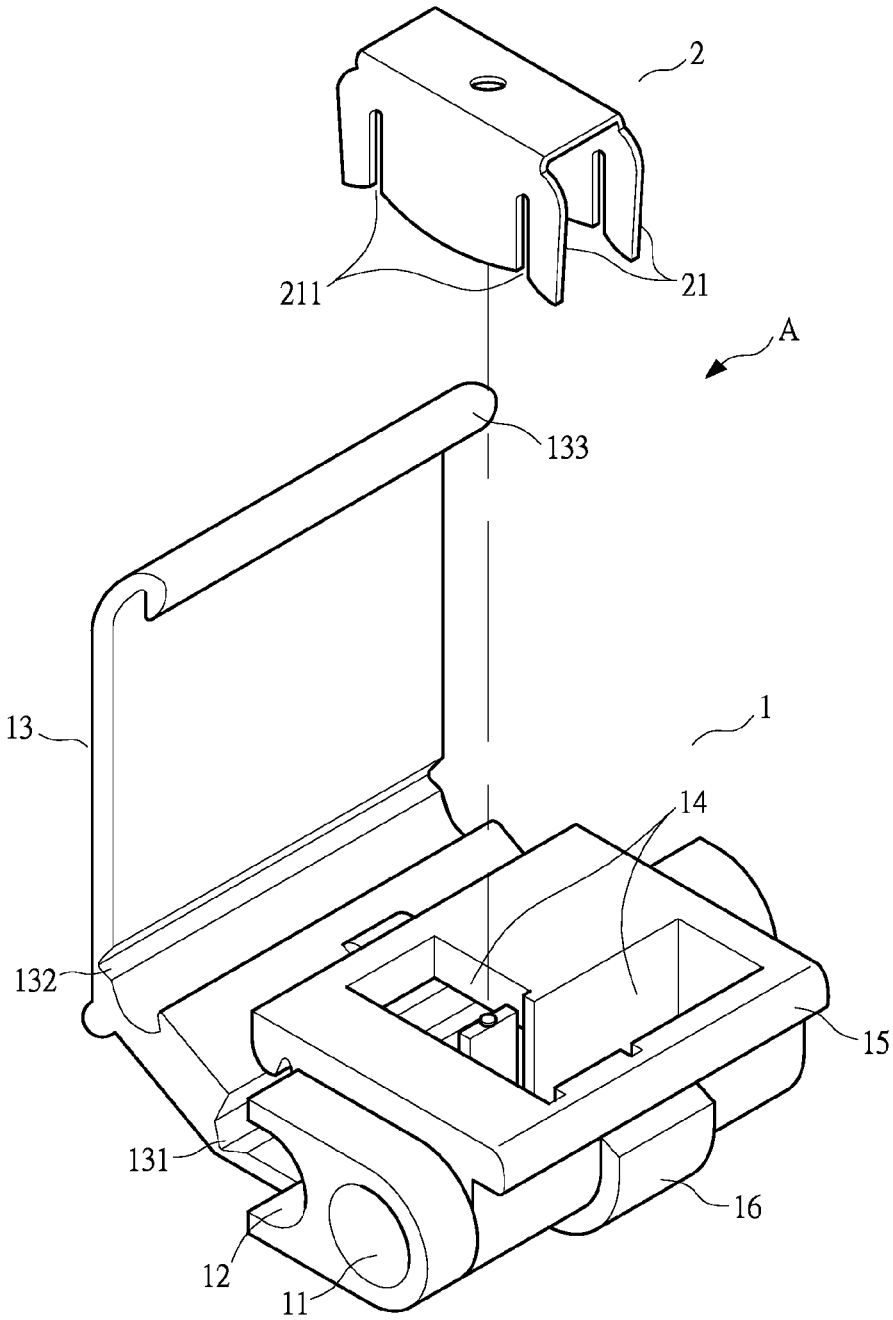
PRIOR ART FIG.1
FIG. 1 is an exploded view of a conventional electrical wire connection device.
Figure 2:
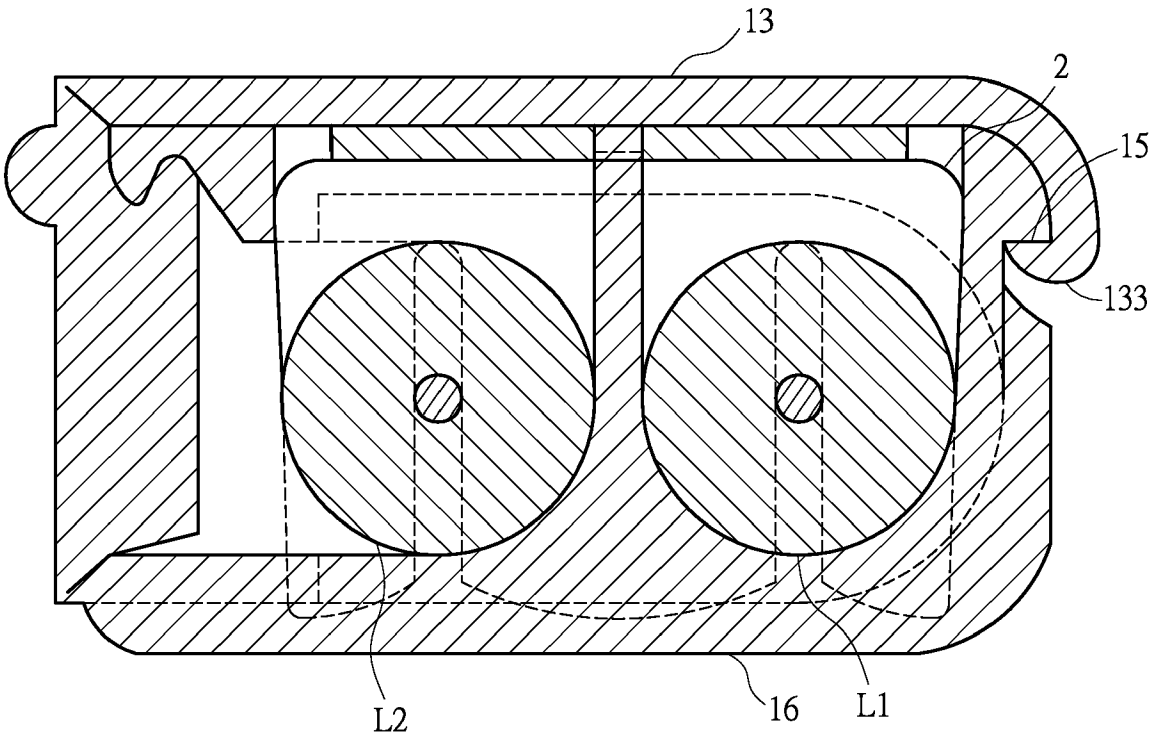
PRIOR ART FIG.2
FIG. 2 is a cross-sectional view of the conventional electrical wire connection device in an assembled form.
Figure 3:
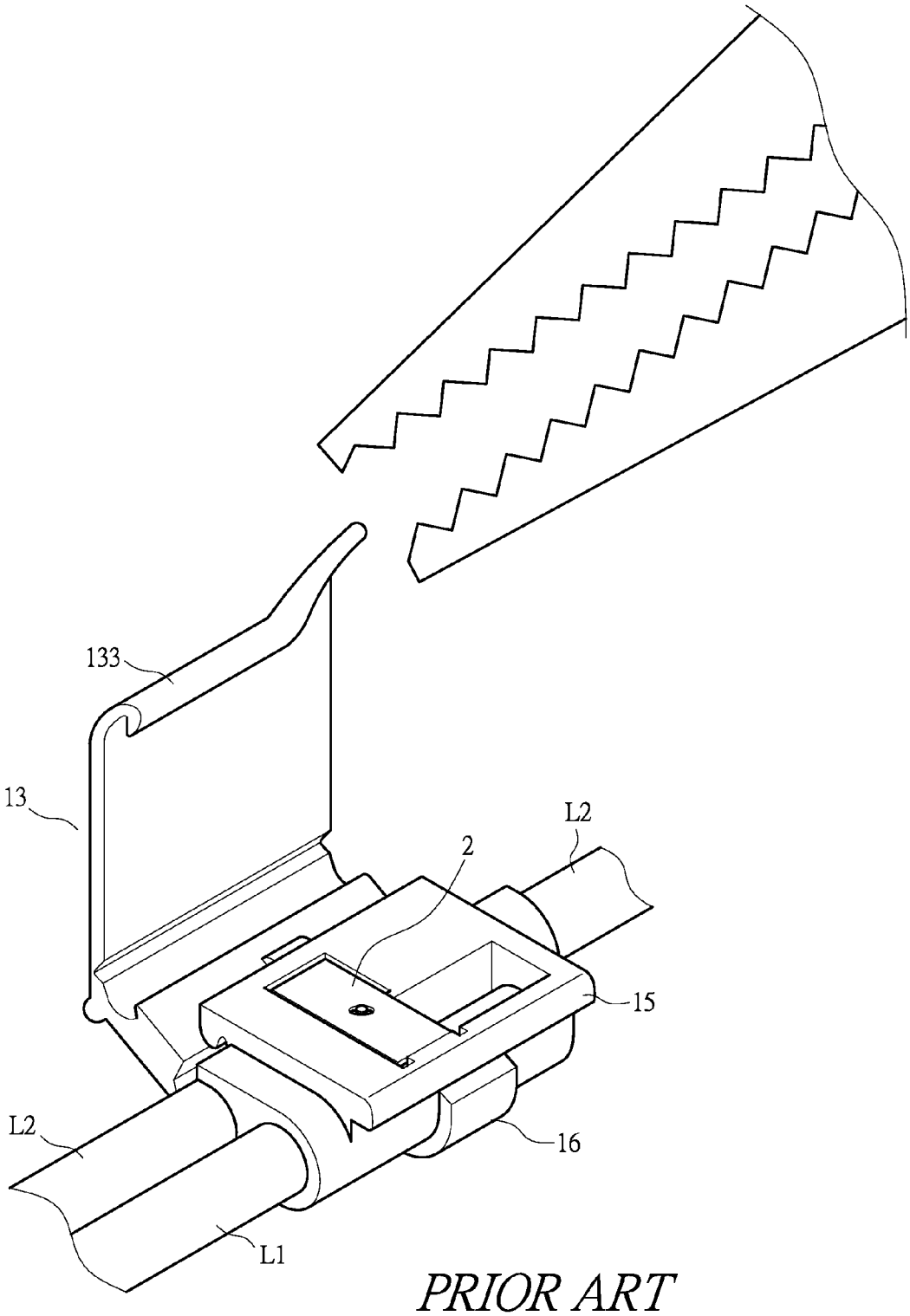
PRIOR ART FIG.3
FIG. 3 is a perspective view illustrating using pliers to open and remove the conventional electrical wire connection device.
Figure 4:
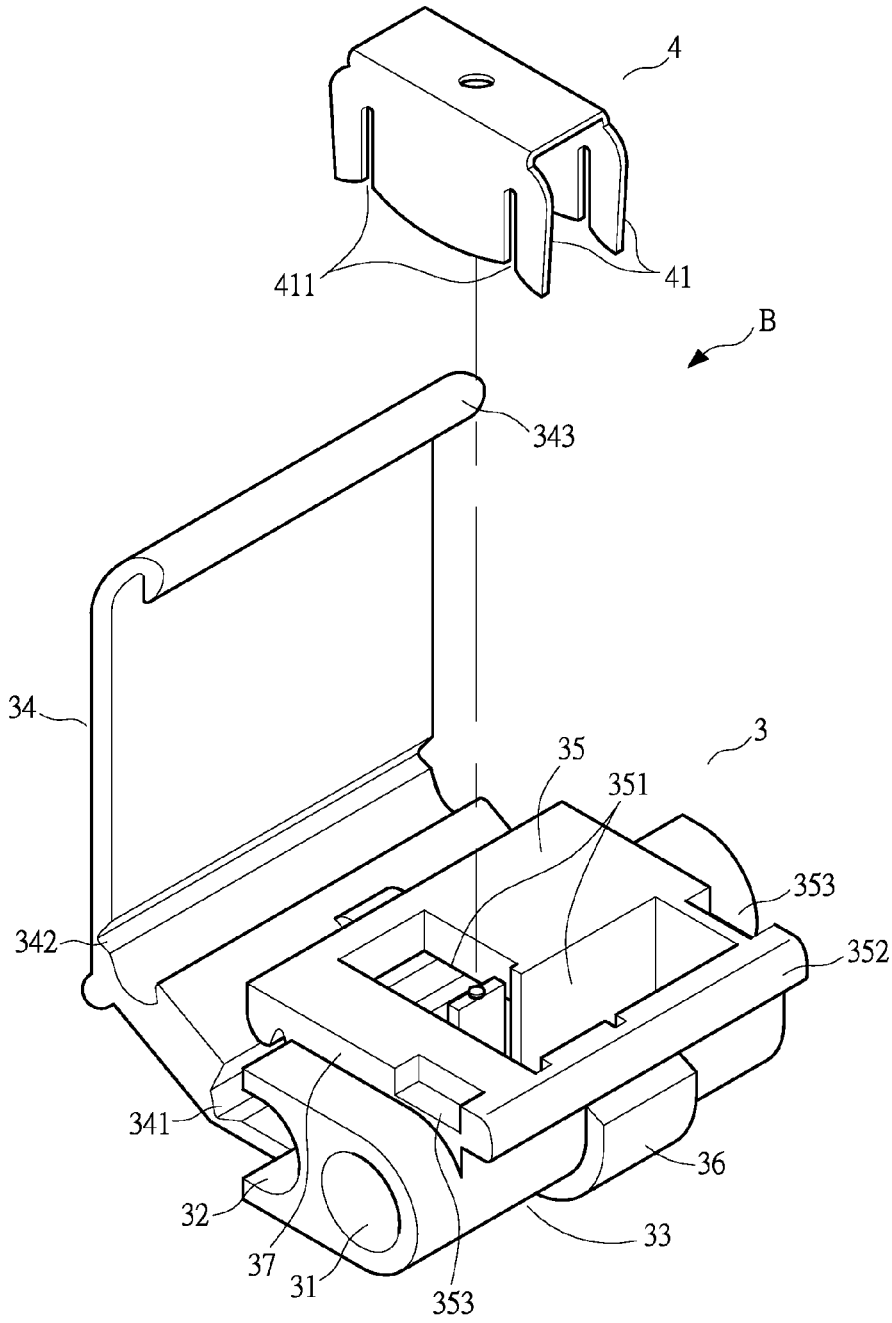
FIG. 4 is an exploded view of an electrical wire connection device constructed in accordance with an embodiment of the present invention.

With reference to the drawings and in particular to FIG. 4, an electrical wire connection device constructed in accordance with the present invention, generally designated at B, comprises a housing 3 and an interconnection member 4.

The housing 3 is made of a plastic material that features electrical insulation and forms a first wire channel 31 and a second wire channel 32. The first wire channel 31 extends from an end of the housing 3 into the body of the housing 3, but not completely through the body of the housing 3 to an opposite end of the housing 3. The second wire channel 32 is substantially parallel to the first wire channel 31 and extends from an end of the housing 3 into and completely through the body of the housing 3 to an opposite end of the housing 3. A lateral side of the second wire channel 32 is open. Extending from a bottom 33 of the housing 3 is cover board 34 that is connected to the bottom 33 of the housing with a first jointing section 341 that is in the form of and rotatable as a hinge. The cover board 34 further comprises a second jointing section 342, which is also in the form and rotatable as a hinge. A remote outer edge of the cover board 34 forms a barb 343. The housing 3 has a top surface 35 in which a recess 351 extending between the first and second wire channels 31, 32 is formed. The recess 351 is open at the top surface 35 of the housing 3. Further, a protrusion 36 is formed on a bottom of the housing 3 at a location corresponding to the recess 351 and the protrusion 36 extends to a side surface of the housing 3 that is outside the first wire channel 31. An outer side edge of the top surface 35 of the housing 3 forms an engaging section 352 that is releasably and matingly engageable with the barb 343 of the cover board 34. In addition, the housing 3 has two end surfaces 37 that respectively intersect the top surface 35 of the housing 3 at two end edges of the top surface 35, each of which forms a cutoff 353 that extends partially into the top surface 35 and the end surface 37 of the housing 3, thereby forming openings in both the top surface 35 and the end surface 37 of the housing 3. When the cover board 34 is closed on the top surface 35 of the housing 3, the cutoff 353 only shows the opening in the end surface 37.

The interconnection member 4 is made of metal materials that are electrical conductive and is made in the form of single or plural blades 41. In the embodiment illustrated, plural blades 41 are taken as an example for explanation. Each blade 41 forms two notches 411.

Figure 5:
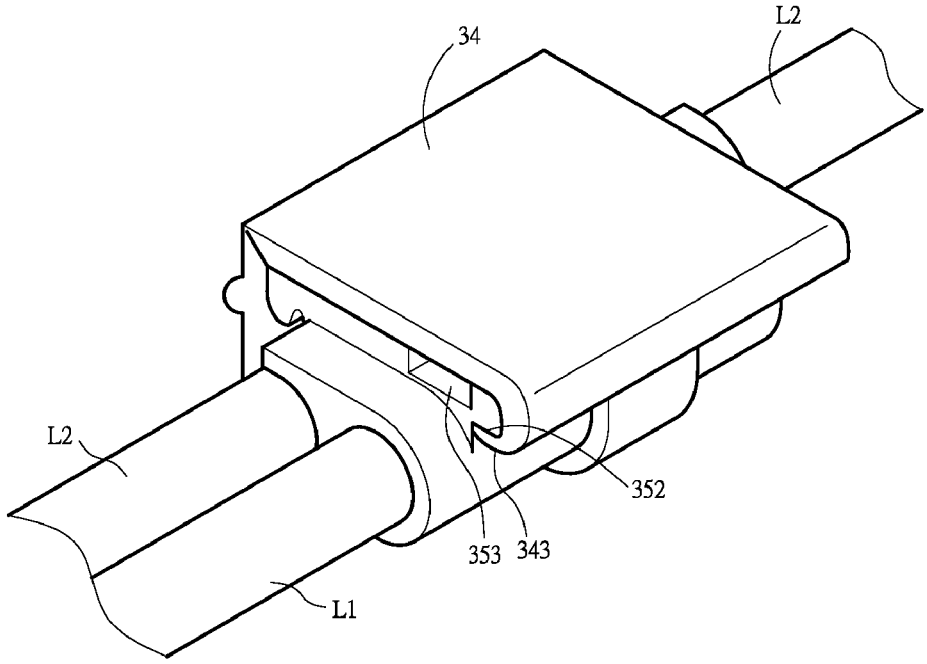
FIG. 5 is a perspective view illustrating the electrical wire connection device of the present invention connecting two wires.

As shown in FIG. 5, to use the electrical wire connection device B to make connection between two electrical wires, a first one (L1) of the two electrical wires is inserted into the first wire channel 31 of the housing 3, while a second one (L2) of the electrical wires is put into the second wire channel 32 of the housing 3. The interconnection member 4 is positioned in the recess 351 defined in the top surface 35 of the housing 3 and is forcibly driven deeply into the recess 351 so that the blades 41 of the interconnection member 4 pierce through insulation enclosure layers of the electrical wires L1, L2 to have the notches 411 of the interconnection member 4 forcibly fit over conductor cores of the electrical wires that are enclosed inside the insulation enclosure layers, whereby electrical connection between the electrical wires L1, L2 is realized. In addition, with the arrangement of the protrusion 36, when the blades 41 of the interconnection member 4 are fit into the recess 351, the blades 41 can be made further deeply into the recess 351 to ensure excellent and secured fitting of the interconnection member 4 in the recess 351, and the mechanical strength of the housing 3 can also be enhanced. Finally, the cover board 34 is closed to the top surface 35 of the housing 3 and the barb 343 of the cover board 34 engages the engaging section 352 of the housing 3 to securely fix the cover board 34 to the housing 3.

Figure 6:
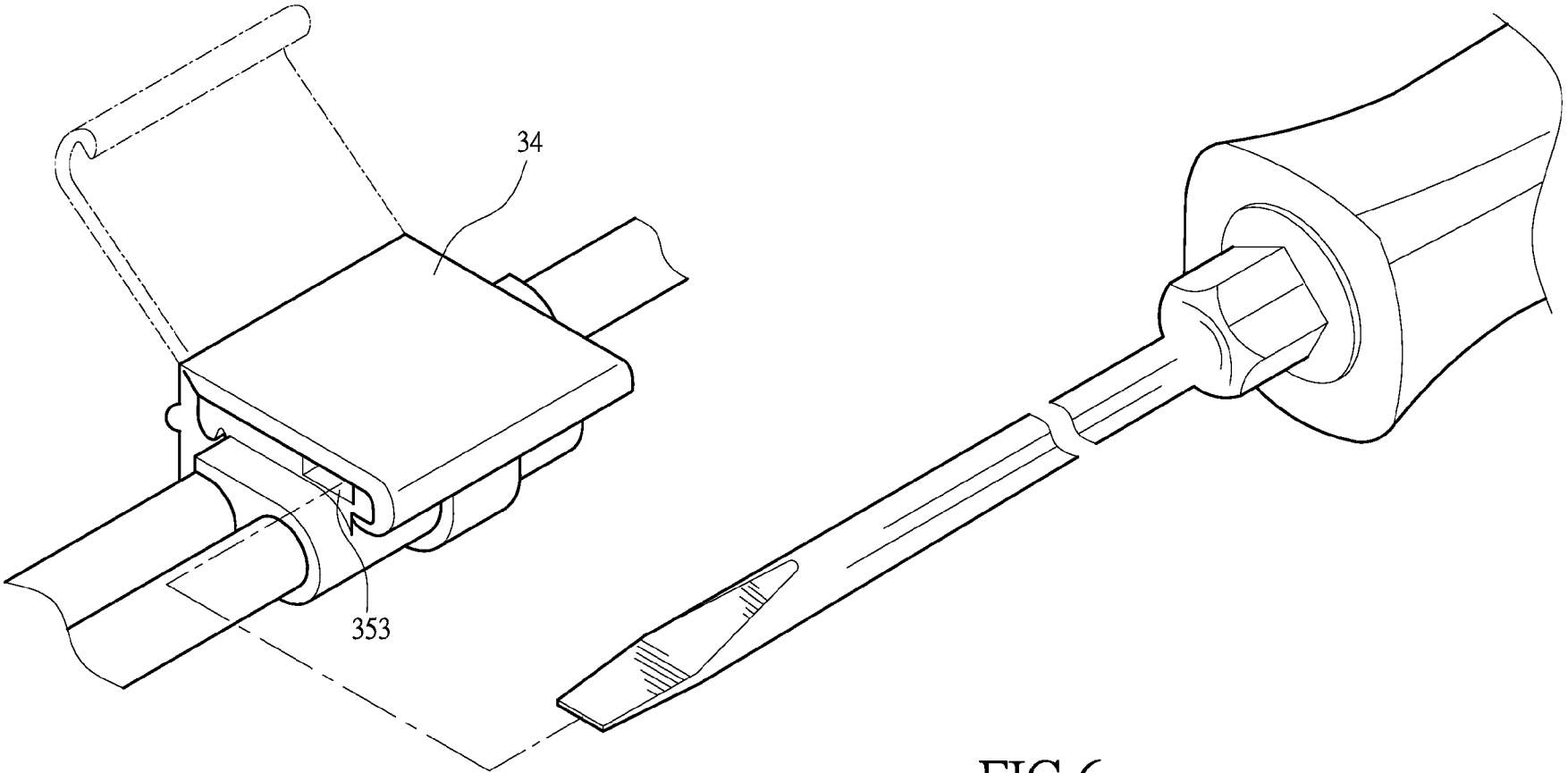
FIG. 6 is a perspective view illustrating opening the electrical wire connection device of the present invention with a screwdriver.

Also referring to FIG. 6, after the interconnection between the wires L1, L2 is done with the interconnection member 4 and the cover board 34 is closed, the opening that the cutoff 353 shows on the top surface 35 of the housing 3 is covered by the cover board 34 and, as mentioned above, the cutoff 353 only shows the opening in the end surface 37 of the housing 3. To attempt to open the cover board 34, an elongate tool with a thin tip, such as a flat-ended screwdriver, can be used and the tip of the tool is inserted into the end-surface opening of the cutoff 353 to apply a force to the cover board 34 by rotating itself or by prying the cover board 34 upward, and as a result of the force applied to the cover board 34 by tool, the cover board 34 is forced away from the top surface 35 of the housing 3 and is thus opened. Subsequent operation of removal of the wires can then be carried out. In this way, the electrical wire connection device can be easily detached from the wires without causing substantial damage to the housing 3 and re-use of the electrical wire connection device can be realized.

Figure 7:
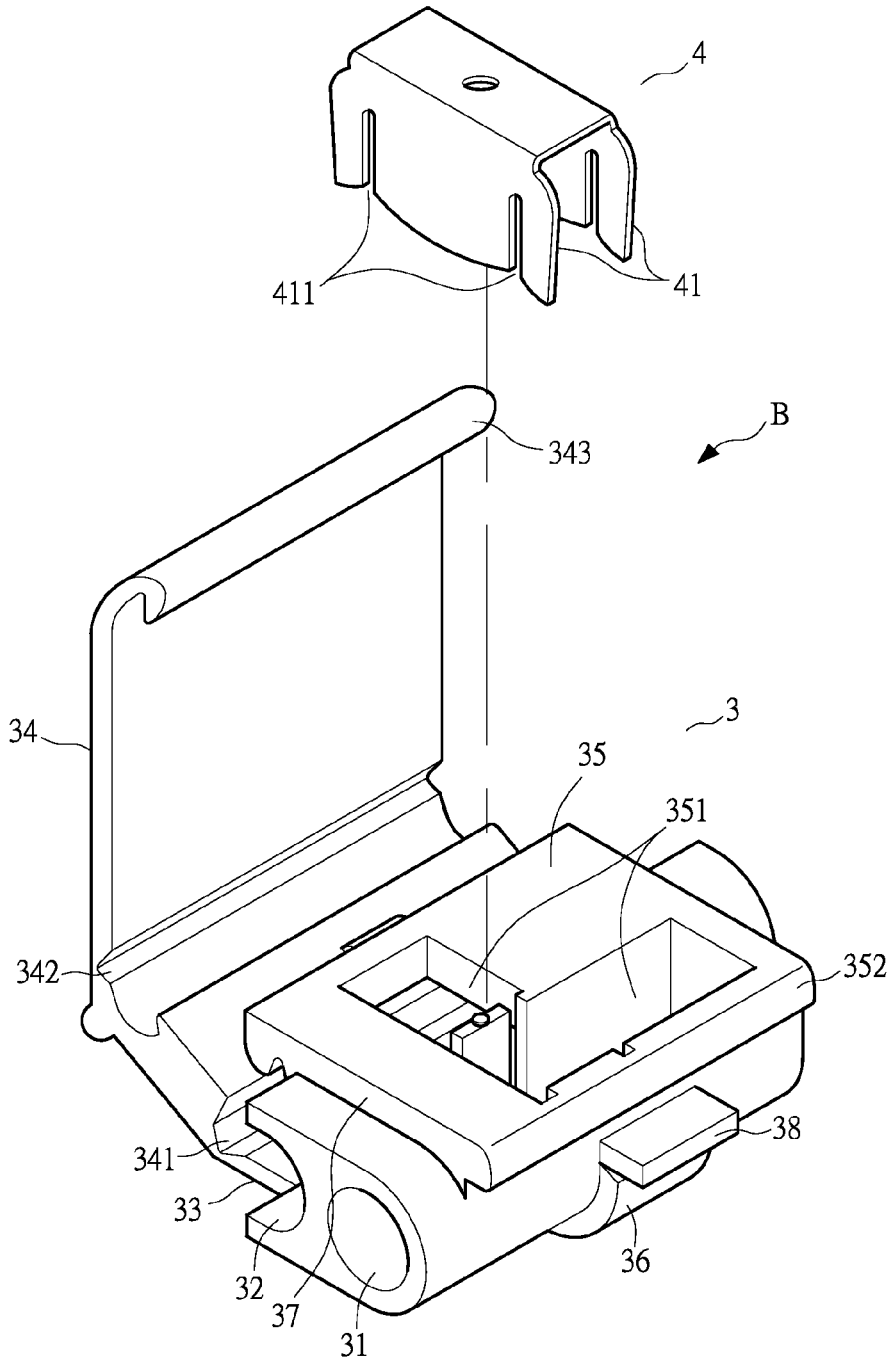
FIG. 7 is an exploded view of an electrical wire connection device constructed in accordance with another embodiment of the present invention.
Figure 8:
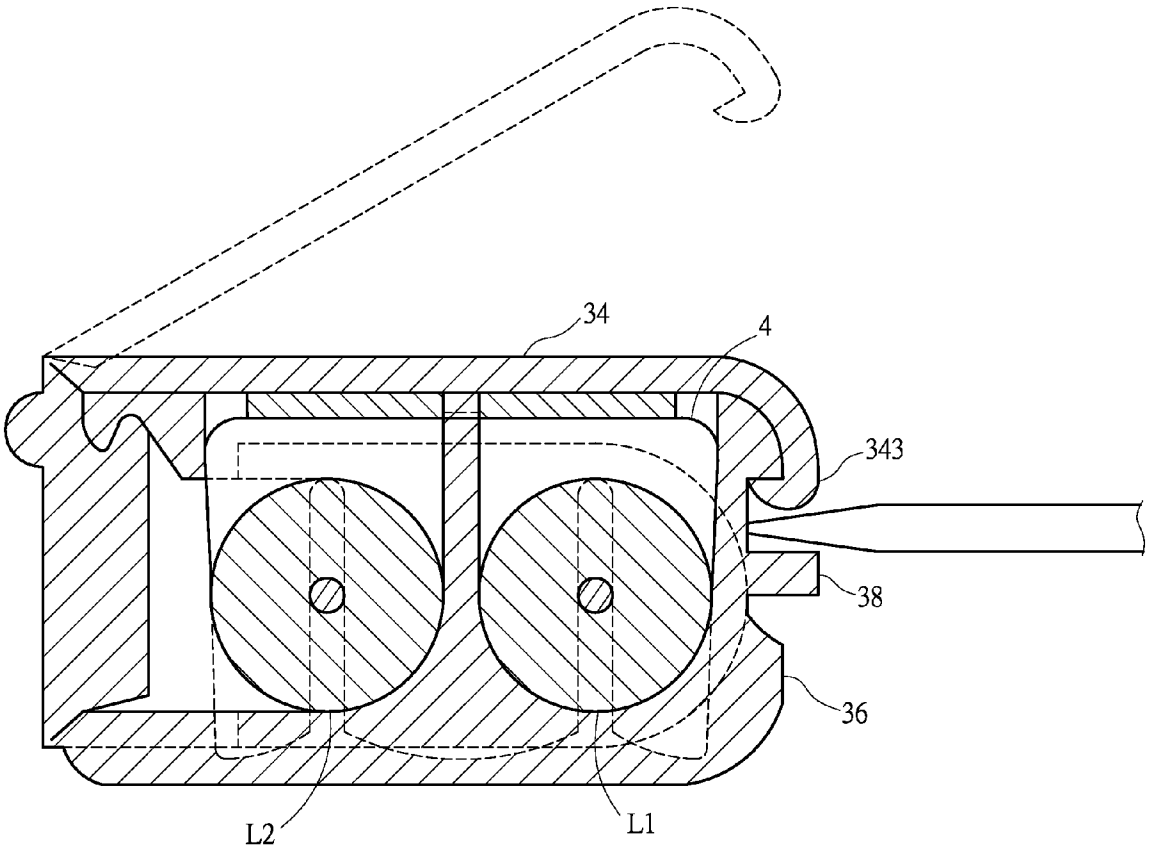
FIG. 8 is a cross-sectional view illustrating opening the electrical wire connection device of said another embodiment of the present invention with a screwdriver.

Also referring to FIG. 7, another embodiment of the electrical wire connection device of the present invention is shown, wherein a rib or projection 38 is formed on the outer side surface of the housing 3 below the engaging section 352. As shown in FIG. 8, to remove the electrical wire connection device, a hand tool, such as a flat-ended screwdriver, is inserted in between the rib 38 and the barb 343 of the cover board 34 that engages the engaging section 352 of the housing, and pries the cover board 34 upward by using the rib 38 as a fulcrum. Thus, the cover board 34 can be easily opened from the top surface 35 of the housing 3 for carrying out subsequent disassembling operation. In this way, the cover board 34 can be efficiently opened without causing substantial damage to the housing 3 and re-use of the electrical wire connection device can be realized.

Figure 9:
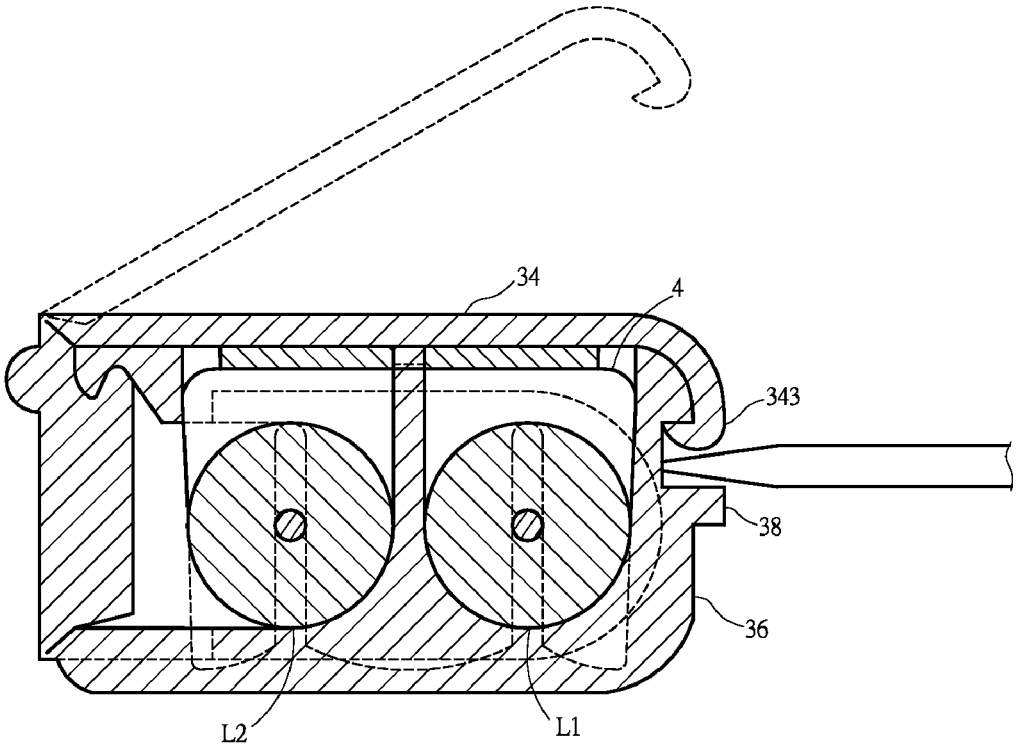
FIG. 9 is a cross-sectional view illustrating opening an electrical wire connection device constructed in accordance with a further embodiment of the present invention with a screwdriver.

Also referring to FIG. 9, the rib 38 that is formed on the outer side surface of the housing 3 can be formed integrally with the protrusion 36 that extends to the outer side surface of the housing 3 to enhance the mechanical strength of the rib 38, which may then provide a strong support or fulcrum for the prying operation with the screwdriver.

Figure 10:
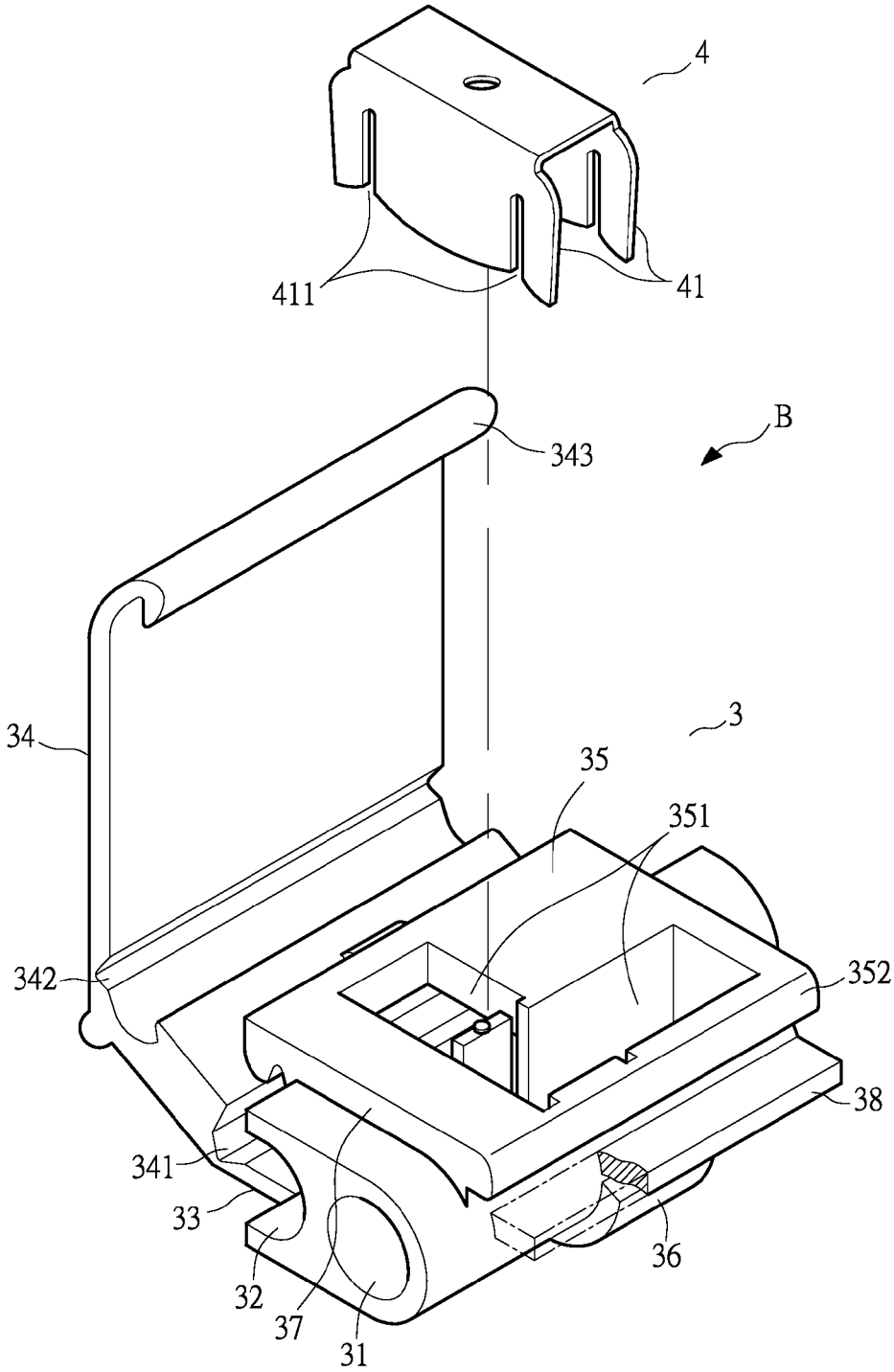
FIG. 10 is an exploded view of an electrical wire connection device constructed in accordance with yet a further embodiment of the present invention.
Figure 11:
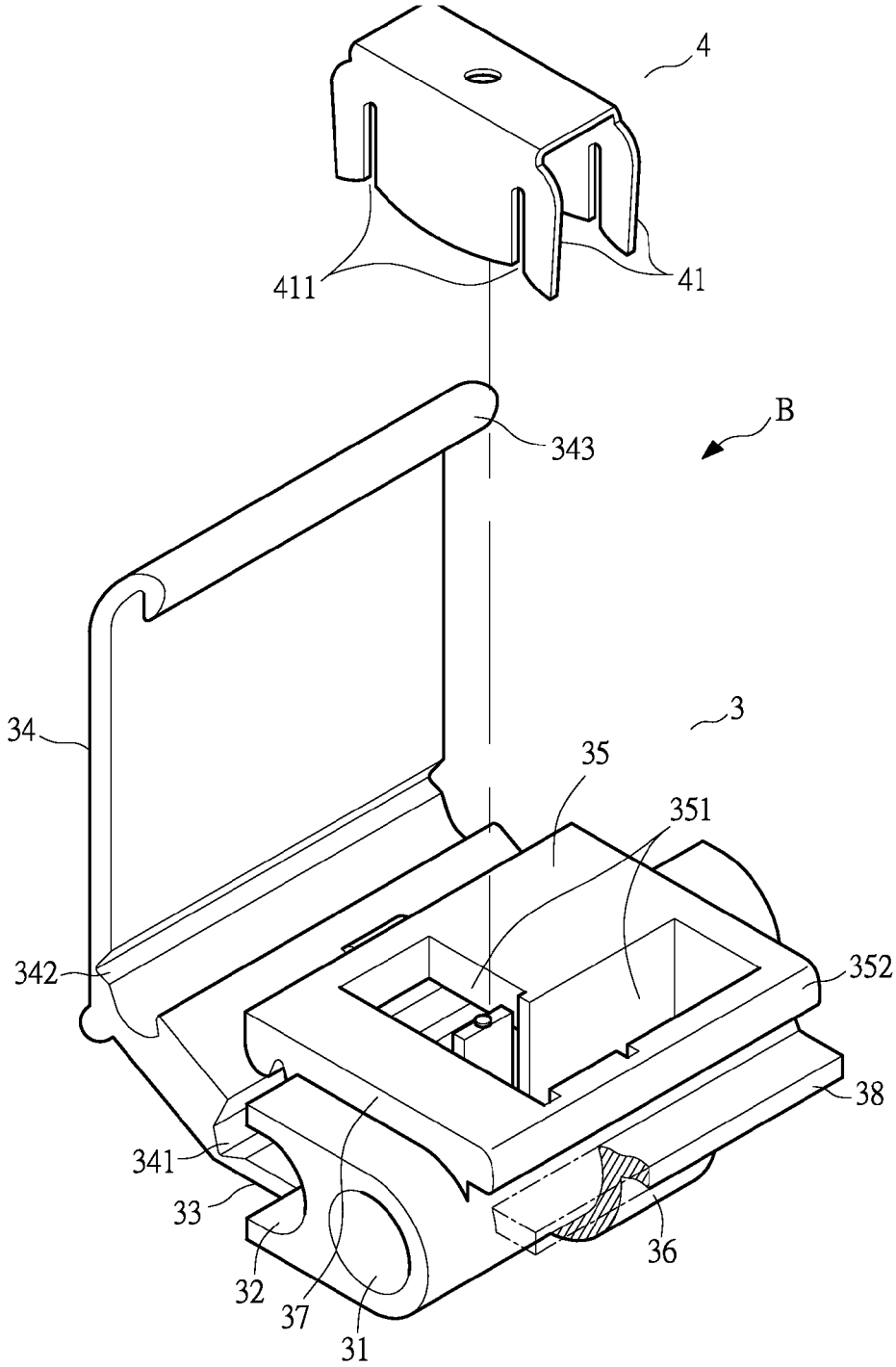
FIG. 11 is an exploded view of an electrical wire connection device constructed in accordance with yet a further embodiment of the present invention.

Also referring to FIGS. 10 and 11, which respectively shows embodiments that the rib 38 is separate from and integrally formed with the protrusion 36, the rib 38 can be formed in such a way that the rib 38 is further extended toward opposite ends of the outer side surface of the housing 3, but is not longer than the length or dimension of the cover board 34 in the direction of the extension of the rib 38. In this way, a large range of length of the rib 38 is provided, which allows for more insertion points for the screwdriver. As a consequence, opening of the cover board 34 is made easier.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An electrical wire connection device comprising:

a housing made of insulation material and forming first and second channels for receiving therein first and second electrical wires, a cover board extending from a bottom of the housing and having a remote free edge forming a barb, the housing having a top surface in which a recess extending between the first and second channels is defined, the top surface of the housing having an outer side edge forming an engaging section engageable with the barb of the cover board; and an interconnection member made of electrically conductive materials and forming at least one blade in which two notches are defined;

wherein the housing has an outer side surface forming a rib below the engaging section, and the housing has opposite end surfaces respectively intersecting the top surface of the housing at end edges, each end edge forming a cutoff so that when the cover board is closed to the top surface of the housing, the cutoff shows an opening in the respective end surface of the housing.

2. The electrical wire connection device as claimed in claim 1, wherein the rib is integrally formed with a protrusion that extends from the bottom of the housing to the outer side surface of the housing.

3. The electrical wire connection device as claimed in claim 1, wherein the rib extends a length smaller than a length of the cover board.

4. The electrical wire connection device as claimed in claim 2, wherein the rib extends a length smaller than a length of the cover board.

* * * * *